US006267270B1

(12) United States Patent
Schaffner

(10) Patent No.: US 6,267,270 B1
(45) Date of Patent: Jul. 31, 2001

(54) LIQUID DISPENSER, ESPECIALLY FOR DISPENSING LIQUID MEDICAMENTS

(76) Inventor: Alfred Schaffner, Strada Cantonale, CH-6805 Mezzovico (CH)

( * ) Notice: Subject to any disclaimer, the term of this patent is extended or adjusted under 35 U.S.C. 154(b) by 0 days.

(21) Appl. No.: 09/486,658

(22) PCT Filed: Aug. 29, 1997

(86) PCT No.: PCT/EP98/04299

§ 371 Date: Feb. 25, 2000

§ 102(e) Date: Feb. 25, 2000

(87) PCT Pub. No.: WO99/11169

PCT Pub. Date: Mar. 11, 1999

(30) Foreign Application Priority Data

Aug. 29, 1997 (DE) ..... 197 37 749

(51) Int. Cl.[7] ..... B65D 37/00

(52) U.S. Cl. ..... 222/209; 222/143; 222/211; 222/420

(58) Field of Search ..... 222/209, 211, 222/215, 143, 420

(56) References Cited

U.S. PATENT DOCUMENTS

| | | | | |
|---|---|---|---|---|
| 2,774,518 | | 12/1956 | Greene . | |
| 3,252,447 | * | 5/1966 | Ramer | 222/209 |
| 4,420,098 | | 12/1983 | Bennett . | |
| 5,265,770 | * | 11/1993 | Matkovich et al. | 222/420 |
| 5,558,257 | | 9/1996 | Braun . | |
| 5,924,151 | * | 7/1999 | Connan | 222/209 |

FOREIGN PATENT DOCUMENTS

| | | |
|---|---|---|
| 500243 | 6/1930 | (DE) . |
| 2459458 | 6/1975 | (DE) . |
| 0639514 | 2/1995 | (EP) . |
| 2668456 | 4/1992 | (FR) . |

* cited by examiner

*Primary Examiner*—Philippe Derakshani
(74) *Attorney, Agent, or Firm*—Horst M. Kasper

(57) ABSTRACT

The invention provides a liquid dispenser for dispensing liquid medicaments, in particular, in metered droplets, in which an upwardly open container (2) can be closed off by means of a deformable diaphragm (3) and liquid is dispensed from the container (2) in the form of droplets through an outlet tube (12) leading out of the interior of the container when slight pressure is exerted on the diaphragm (3), the opening of the outlet tube (12) pointing at the upper surface of the diaphragm (3). This allows an instrument used to exert the pressure on the diaphragm (3), e.g. pincers holding a piece of cotton wool, also to be used at the same time to take up the liquid displaced from the container (2); single-handed operation is thus possible. Any unused liquid cannot run back. The instrument comes into contact only with the diaphragm (3) and the liquid dispensed onto it, and the diaphragm (3) can be exchanged before each re-use, thus satisfying even the high hygiene requirements in the medical sector. (FIG. 1) Using a mounting part (21) which has an opening (22) on its upper side to accommodate the liquid dispenser (1) and connecting means on its side faces, in the form, for example, of a tongue-and-groove joint (23, 24), it is possible to arrange any number of liquid dispensers (1) in various directions to form a kind of battery.

20 Claims, 2 Drawing Sheets

LIQUID DISPENSER, ESPECIALLY FOR DISPENSING LIQUID MEDICAMENTS

DESCRIPTION

Figure 1:
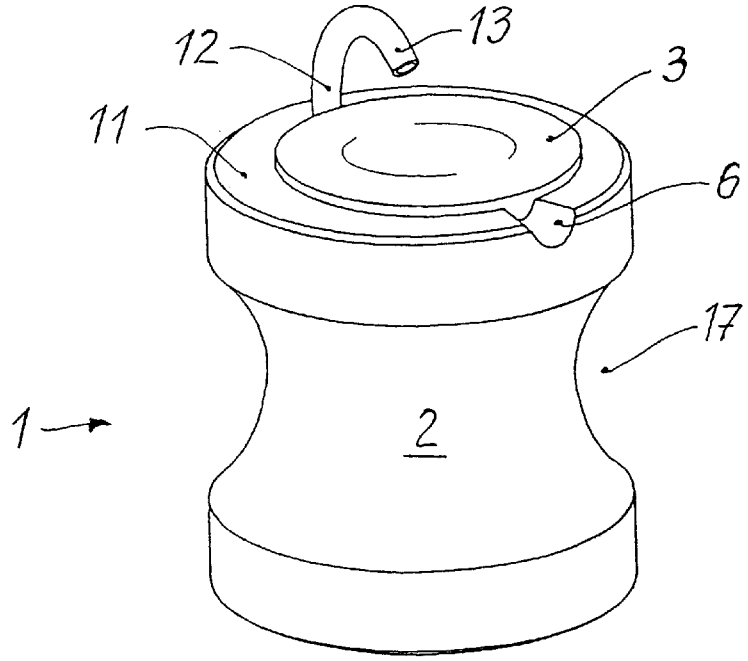

The invention relates to a liquid dispenser, in particular liquid medicament dispenser, for the metered dispensing of drops of liquid, in particular a liquid medicament, in which the storage container can be closed off by a deformable diaphragm and the liquid contained in said storage container can be dispensed at an outlet tube through volume displacement by light pressure on the diaphragm, and to a mounting for said liquid dispenser.

There is a need, particularly in the medical sector, though not exclusively in this sector, to be able to draw liquids in extremely small doses, i.e. in the form of droplets from a storage container for immediate use. Mention may be made here, by way of example, to the drawing of a disinfectant or some other liquid medicament in dental practice during and for treatment of a patient. It goes without saying that hygiene standards must be strict and any contamination must be avoided.

Another feature that would be particularly desirable is the possibility of single-handed operation of the dispenser, i.e. the ability to draw a droplet of the liquid with one hand using pincers and a piece of cotton wool held with them.

There is a known medicament dispenser in the form of a cup-shaped storage container which can be closed off by a diaphragm-like lid and has an outlet tube which projects laterally in the form of a spout and under which a small bowl is to be placed. A droplet of the liquid in the container is dispensed at the outlet tube by brief pressure on the diaphragm-like lid, and this droplet falls into the bowl and can there be taken up with the pincers and a cotton wool pellet. The bowl can be exchanged and resterilized. The disadvantage of this dispenser is its two-part construction comprising a storage container and a bowl for the liquid drawn; as a result, it takes up a relatively large amount of space overall and, in particular, it does not allow single-handed operation. The diaphragm-like lid of the storage container must always be pressed with one finger of one hand while the other hand holds the pincers with the piece of cotton wool in order to take up the dispensed droplet at the outlet tube or in the bowl.

In another known medicament dispenser, the storage container is closed off by a diaphragm in which a small outlet opening is provided. By means of pressure, with the pincers for example, on the diaphragm, liquid is pumped out of the container, through the outlet opening, onto the diaphragm and can be taken up there. Although single-handed operation is possible here, hygiene requirements are not met sufficiently. Since the liquid is pumped directly on the lid closing off the storage container, unused liquid cannot be prevented from flowing back into the container. For reasons of hygiene, this dispenser is unsuitable at least in the medical sector and wherever contamination must be avoided.

Commercially available small glass containers with a lid, referred to as Dappen dishes, are furthermore used. However, single-handed metering is not possible with these and the pincers must always be dipped into the liquid, inevitably resulting in contamination. The container can only be sterilized as a whole.

It is the object of the invention to provide a liquid dispenser for dropwise metering of a liquid which allows single-handed operation and, at the same time, is suitable particularly as a liquid-medicament dispenser, i.e. meets the strict hygiene requirements that have to be met in the medical sector. Parts which come into contact with the pincers and the piece of cotton wool or some other instrument for taking up the liquid must be easily exchangeable and sterilizable. The dispenser should be of compact, stable construction and be suitable for installation in shallow drawers, possibly together with a number of others in a kind of battery for drawing various liquids.

According to the invention, this is achieved by virtue of the fact that the opening of the outlet tube points at the upper surface of the diaphragm, which rests in a sealing manner on the container opening and is interchangeable. Thus it is possible to use an instrument, e.g. pincers holding a piece of cotton wool, with which the pressure is exerted on the diaphragm, simultaneously to take up the liquid dispensed dropwise at the outlet tube; single-handed operation has been achieved. The piece of cotton wool or pincers come into contact only with the liquid dispensed onto the diaphragm and never with the contents of the container; unused, contaminated liquid cannot flow back. Hygienic operation of the liquid dispenser is ensured.

The upper surface of the diaphragm is preferably curved slightly inwards so that it forms a small collecting or removal container.

The diaphragm preferably rests on a step provided on the inner edge of the container opening and can simply be exchanged before each further operation, this likewise promoting hygiene.

If it is regarded as advantageous for a particular application, it is also possible to cut a step into the underside of the diaphragm, by means of which step it rests on the inner edge of the container opening or on a step provided at the inner edge of the container opening.

A depression on the container rim projecting radially beyond the diaphragm makes it easier to exchange the diaphragm by allowing it to be grasped easily at this point, e.g. with pincers. According to another embodiment of the invention, a small peg can be provided on the diaphragm, and, for exchange, the diaphragm can be grasped by this peg with pincers. It is then possible to dispense with the depression in the container rim. As another alternative, the diaphragm can be provided with a small extension or grip similar to a spoon handle to facilitate the exchange of the diaphragm by an assistant, without the need to use pincers.

A tubular connection extending from the container rim projecting radially beyond the diaphragm as far as the interior of the container is provided in the container wall, and an outlet tube, which points towards the diaphragm, is inserted into this connection. When pressure is exerted on the diaphragm, liquid is displaced from the interior of the container into the outlet tube via the tubular connection, and can emerge from the opening of said tube above the diaphragm and be taken up in a single-handed operation.

In one embodiment of the liquid dispenser according to the invention, a radial hole opening directly into the interior of the container via the internal bottom is provided in the container wall and, in the container wall, this hole meets a second, vertical or almost vertical, hole which starts from the container rim projecting radially beyond the diaphragm. An outlet tube is pushed or pressed into this vertical hole, the end of said tube being bent towards the diaphragm. The lateral hole is sealed off from the outside by a plug or peg. This embodiment is advantageous from a production-engineering point of view when the container is manufactured as a turned part made, for example, of high-grade steel.

Particularly when the liquid dispenser is produced from plastic, it is also possible for the tubular connection to be formed laterally on the container wall.

It is advantageous if the tubular connection or vertical hole is divided by a step into a narrower section and a wider section, allowing the outlet tube pushed into the wider section to rest on the step.

If the lateral surface of the container has a concave curvature, the dispenser can be grasped easily by hand and moved as required.

The standing surface of the container is preferably an annular surface, it being possible to achieve this by a concave curvature or a central recess in the external bottom surface. This allows the dispenser to be placed in a manner secure against slipping on a surface with corresponding raised elements. Good stability is achieved.

According to another proposal, the container can be inserted into a mounting part which has an essentially cubic shape and in the upper side of which an opening to accommodate the container is provided, on the edge of which opening the container can rest by a circumferential collar formed on it.

A plurality of mounting parts can advantageously be connected to one another to form a kind of battery by connecting means formed on the side faces.

These connecting means can be designed as a tongue-and-groove joint.

Dovetail recesses (grooves) are formed on those two side faces which lie opposite one another in one direction and dovetail extensions (tongues) which fit into the recesses (grooves) are preferably formed on those two side faces of each mounting part which lie opposite one another in the other direction.

A pin-shaped extension, which fits into a corresponding recess in the container collar, can be formed on the upper side of each mounting part in the bearing area of the container collar. This allows the liquid dispenser to be secured against rotation in the mounting.

The diaphragm and/or the outlet tube and/or the container itself can be colored in accordance with a color code denoting the contents of the container; this is advantageous particularly when a plurality of the liquid dispensers according to the invention, with different contents, are arranged to form a kind of battery.

The container and the outlet tube are preferably composed of a noncorroding material. If the container is composed of nickel-chromium steel, it can advantageously be produced as a turned part. However, it is just as advantageous to injection-mold it from plastic.

A particularly suitable material for the diaphragm is silicone rubber; however, it can also be composed of a plastic, such as polystyrene. In the latter case, it is expedient if a sealing ring is arranged between the diaphragm and a step on the inner edge of the container.

The diaphragm can be designed as a disposable part for a single use.

The invention will be explained in greater detail below by way of example with reference to the attached drawings, in which:

FIG. 1 is a perspective view of a liquid dispenser according to the invention.

Figure 3:
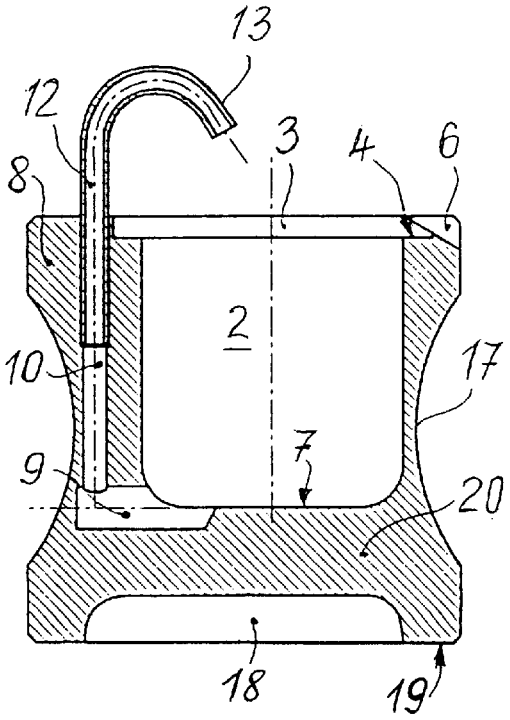
Figure 2:
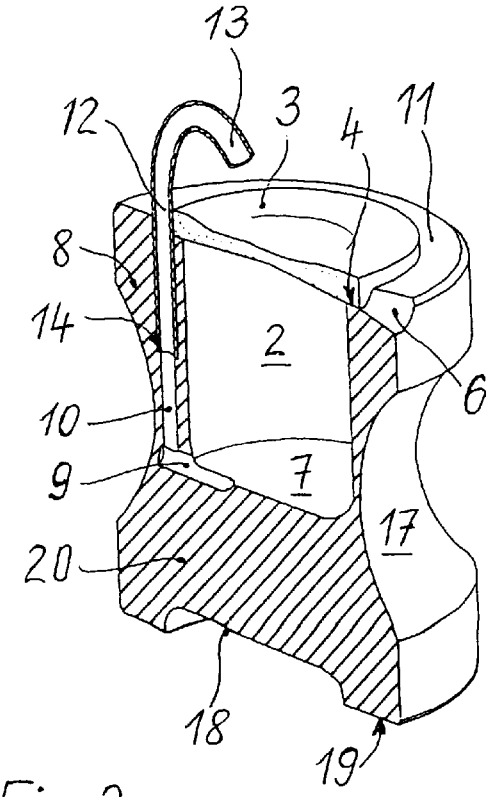
Figure 4:
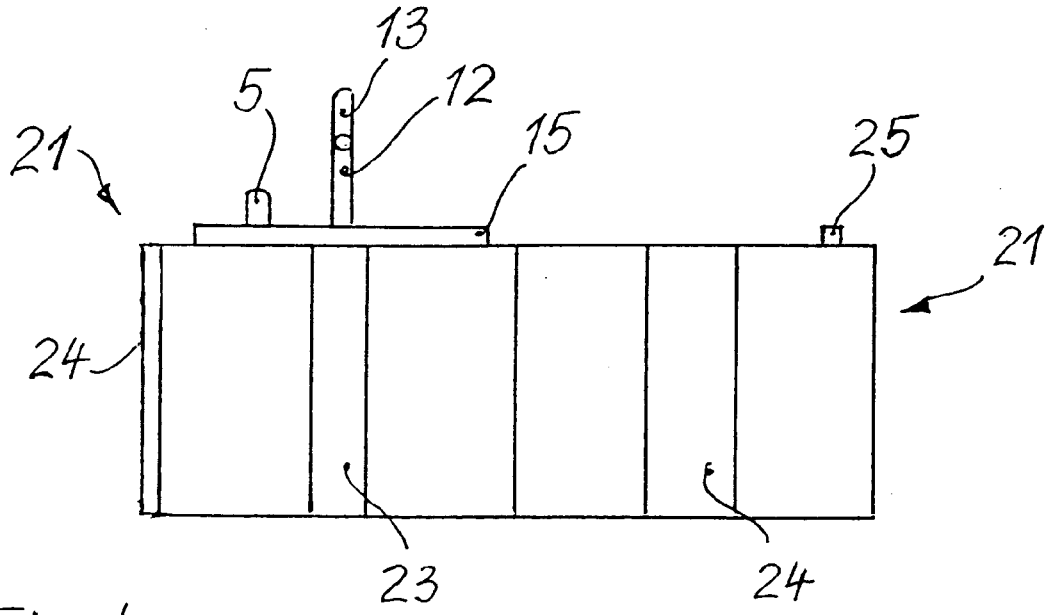
Figure 5:
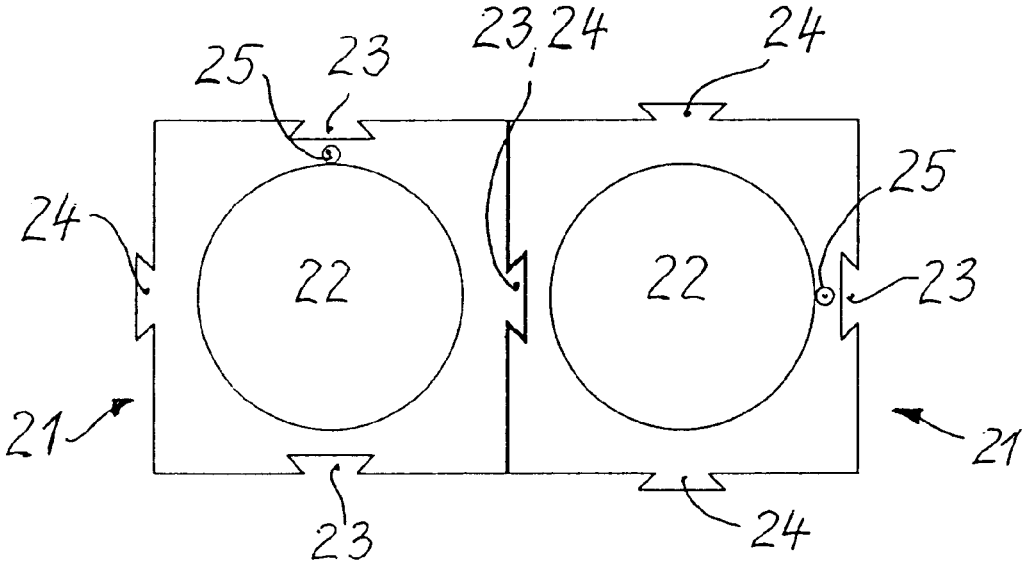

FIG. 2 is a central section through the liquid dispenser shown in FIG. 1, likewise in perspective, FIG. 3 is a sectional view of a modified embodiment of the liquid dispenser, FIG. 4 is a side view of two interconnected mounting parts for liquid dispensers according to the invention, with a liquid dispenser inserted into one of the mounting parts, FIG. 5 shows a plan view of two interconnected mounting parts in accordance with FIG. 4, without a liquid dispenser.

The liquid dispenser 1 comprises an essentially cylindrical or cup-shaped container 2, which is open at the top. A replaceable diaphragm 3 which forms a seal with the edge is inserted into the opening. A step 4, on which the diaphragm 3 can rest, is preferably provided for this purpose on the edge of the container opening. If it is considered advantageous for particular applications, a step can also be cut into the underside of the diaphragm 3, starting from the outer edge, this step allowing the diaphragm 3 to rest on the inner edge of the container 2 or on the step 4 provided on the inner edge of the container. It is advantageous if a small depression 6 is provided at the outer edge of the container 2, this depression making it easier to exchange the diaphragm 3 by allowing it to be grasped easily at that point with an instrument, e.g. pincers.

According to another embodiment, the diaphragm can be provided with a small peg 5 (see FIG. 4) which allows it to be gripped easily with pincers for exchange; the depression 6 is then unnecessary.

As another alternative, the diaphragm can be provided with a small extension or grip similar to a spoon handle. This allows the diaphragm to be exchanged even without the aid of pincers and makes it easier, for example, for an assistant.

A tubular connection 9, 10 extending from the container rim 11 projecting radially beyond the diaphragm 3 into the interior of the container is provided in the container wall 8. For this purpose, a radial hole 9 which opens into the interior of the container directly via the internal bottom 7 and, in the container wall 8, meets a second, vertical or almost vertical, hole 10 which starts from the container rim 11 projecting radially beyond the diaphragm 3, can be made from the outside in the container side wall 8. The radial hole 9 is sealed off from the outside by a plug or peg (not shown). An outlet tube 12 is pressed into the vertical hole 10 and its projecting end 13 is bent down towards the diaphragm 3. For this purpose, it is advantageous if the vertical hole 10 is divided by a step 14 into a narrower section and a wider section. When the outlet tube 12 is pushed or pressed into the wider section from above, it can rest on the step 14 and adopt a precise position.

Once the container 2 has been filled with a liquid and covered with the diaphragm 3, light pressure can be exerted on the diaphragm 3, e.g. with pincers holding a piece of cotton wool, to change the volume of the interior of the container in such a way that a small quantity of the liquid is forced upwards through the holes 9 and 10 and leaves the outlet tube 12 in the form of droplets, allowing it to be collected or absorbed directly on the upper side of the diaphragm 3 by means of the piece of cotton wool used to exert the pressure. For this purpose, the upper surface of the diaphragm 3 is preferably curved slightly inwards to form a small collecting and removal receptacle. One-handed operation is thus possible.

The piece of cotton wool or instrument by means of which the pressure is exerted on the diaphragm 3 comes into contact only with the metered quantity of liquid dispensed onto the diaphragm 3 and never with the reserve of liquid in the interior of the container. There is no possibility of any unused liquid flowing back. After each use, the diaphragm 3 can be removed and replaced by a new one. The diaphragm 3 can either be designed as a disposable element for a single use or be resterilized for reuse. In either case, strict hygiene requirements can be met without the need to frequently resterilize the entire liquid dispenser.

As can be seen from FIGS. 1 to 3, the lateral surface of the container 2 can have a concave curvature 17. This not only lends the dispenser a pleasant appearance but makes it easy to handle and allows it to be grasped more easily with the hand if, for example it is to be moved. It is likewise possible for the external bottom surface to be curved centrically inward or have a central recess 18; this leaves an annular surface 19 on the bottom as a standing surface, which allows the individual liquid dispenser to be placed in a manner secure against slipping on a surface correspondingly provided with raised elements. This gives the required stability.

The liquid dispenser can be arranged with a number of others in a kind of battery on a corresponding surface, e.g. in a drawer, allowing different liquids, e.g. liquid medicaments, to be held ready and removed in metered quantities as and when required. The liquids can be distinguished by a color code by coloring the diaphragms 3 or the outlet tubes 12 or both of the individual dispensers differently. Particularly when the liquid dispenser is manufactured from plastic, it is also possible for the container itself to be colored in accordance with a color code.

FIG. 3 shows a slightly modified embodiment of the liquid dispenser. It is clear from a comparison with FIG. 2 that the liquid dispenser can be configured to hold a different volume if required while retaining essentially the same external dimensions. The container 2 has a relatively thick bottom wall 20. To obtain a larger capacity, the container 2 is merely manufactured with a lower internal bottom 7 and the thickness of the bottom wall 20 is correspondingly reduced.

This is particularly advantageous when a plurality of liquid dispensers of different capacities is arranged in a battery. Even then, the arrangement still has a uniform appearance; if some of the dispensers have a larger capacity, this does not mean that they protrude, which would be a hindrance to their arrangement in a shallow drawer.

In accordance with its preferred use, the liquid dispenser together with the outlet tube 12 is composed of a noncorroding material, preferably of nickel-chromium steel, but glass or porcelain is also conceivable, as is manufacture from a suitable plastic.

A particularly suitable material for the diaphragm 3 is silicone rubber; however it can also be manufactured from a plastic, such as polystyrene, although in this case a separate rubber sealing ring on which the plastic diaphragm can rest should then be provided in the container opening. In this case, it is expedient to provide the step 4 on the inner edge of the container opening to accommodate the sealing ring.

As already mentioned, it should be possible to group or arrange a plurality of liquid dispensers 1 with the same or different contents to form a kind of battery. FIGS. 4 and 5 show a side view and a plan view of two identical interconnected mounting parts 21. Each such mounting part 21 can hold one liquid dispenser 1 in an opening 22, and any desired number of mounting parts 21 can be connected to one another on any of four sides. For this purpose, they have matching connecting means on their side faces, e.g. a groove-and-tongue joint 23, 24. In the embodiment illustrated, the mounting parts 21 are essentially cubic in shape; the opening 22 for receiving the liquid dispenser 1 is on the upper side of each mounting part 21 (see FIG. 5). A dovetail groove 23 and a dovetail tongue 24 which fits into the groove 23 are in each case formed in or on mutually opposing side faces. This tongue-and-groove joint 23, 24 allows any number of mounting parts 21 to be connected in any one of four directions, e.g. in a line, at right angles, in a cross shape or over an extended area.

For insertion into the mounting part 21, the liquid dispenser 1 can have a radially formed collar 15 by means of which it can rest on the edge of the opening 22 of the mounting part 21. To prevent the liquid dispenser 1 from turning accidentally in the opening 22, a pin-shaped extension 25 can be provided on the upper side of the mounting part 21, next to the opening 22, and this extension can engage in a recess (not shown) in the collar 15 of the liquid dispenser 1. To allow the liquid dispensers 1 to be aligned uniformly, it is advantageous if two such recesses are provided in he collar 15, with a 90° offset. However, it is also possible, for the same purpose, to arrange two pin-shaped extensions 25 on the upper side of the mounting part 21, with a 90° offset.

What is claimed is:

1. A liquid dispenser for a metered dispensing of drops of a liquid wherein an upwardly open storage container can be closed off by a deformable diaphragm and the liquid contained in the storage container can be dispensed at an outlet tube through volume displacement by exerting a light pressure on the diaphragm, wherein the opening of the outlet tube (12) points at an upper surface of the diaphragm (3), which rests in a sealing manner on the container opening and is interchangeable.

2. The liquid dispenser as claimed in claim 1, wherein the upper surface of the diaphragm (3) is curved slightly inward into the storage container.

3. The liquid dispenser as claimed in claim 1, wherein a step (4) is provided on an inner edge of the container opening as a support for the diaphragm (3).

4. The liquid dispenser as claimed in claim 1, wherein a depression (6) is provided at one point on a container rim (11) projecting radially beyond the diaphragm (3).

5. The liquid dispenser as claimed in claim 1, wherein a peg (5) is provided on the diaphragm (3).

6. The liquid dispenser as claimed in claim 1, wherein an extension or grip similar to a spoon handle is provided on the diaphragm (3).

7. The liquid dispenser as claimed in claim 1, wherein a tubular connection (9, 10) extending from a container rim (11) projecting radially beyond the diaphragm (3) as far as an interior of the storage container is provided in a container wall (8), and an outlet tube (12), which points towards the diaphragm (3), is inserted into this tubular connection.

8. The liquid dispenser as claimed in claim 7, wherein a radial hole (9) is opening directly into the interior of the storage container via an internal bottom (7) and is provided in the container wall (8) and this hole meets a second, vertical or almost vertical, hole (10) in the container wall (8) which second, vertical or almost vertical, hole (10) starts from the container rim (11) projecting radially beyond the diaphragm (3), wherein the outlet tube (12) is pushed or pressed into this second hole (10), wherein an end (13) of said outlet tube is bent towards the diaphragm (3), and wherein the radial hole (9) is sealed off from the outside by a plug or peg.

9. The liquid dispenser as claimed in claim 7, wherein the tubular connection (9, 10) is formed on a side of the container wall (8).

10. The liquid dispenser as claimed in claim 8, wherein the tubular connection or second hole (10) is divided by a step (14) into a narrower section and a wider section and wherein the outlet tube (12) is pushed into the wider section and rests on the step (14).

11. The liquid dispenser as claimed in claim 1, wherein the diaphragm (3) and/or the outlet tube (12) and/or the storage container (2) is or are colored in accordance with a color code denoting the contents of the storage container (2).

12. The liquid dispenser as claimed in claim 1, wherein the storage container (2) and the outlet tube (12) are composed of a noncorroding material.

13. The liquid dispenser as claimed in claim 1, wherein the diaphragm (3) is composed of silicone rubber.

14. The liquid dispenser as claimed in claim 1, wherein the diaphragm (3) is composed of polystyrene and wherein a sealing ring is arranged between the diaphragm (3) and a step (4) on an inner edge of the storage container.

15. The liquid dispenser as claimed in claim 1, wherein the diaphragm (3) is a disposable part for a single use.

16. A liquid dispenser for a metered dispensing of drops of a liquid comprising a deformable diaphragm having an upper surface;

an outlet tube having an opening;

an upwardly open storage container having an opening and having the outlet tube attached, and containing liquid, wherein the opening of the storage container is closed off by the deformable diaphragm, wherein the liquid contained in the storage container can be dispensed through the outlet tube based on a volume displacement by exerting a light pressure on the diaphragm, wherein the opening of the outlet tube points at the upper surface of the diaphragm, wherein the diaphragm rests in a sealing manner on the container opening and wherein the diaphragm is interchangeable.

17. The liquid dispenser as claimed in claim 16, wherein the upper surface of the diaphragm is curved slightly inward into the storage container, wherein the dispenser is a liquid medicine dispenser, wherein the liquid metered is a liquid medicine; further comprising a step provided on an inner edge of the opening of the storage container as a support for the diaphragm;

a depression provided at one point on a container rim projecting radially beyond the diaphragm;

a peg furnished on the diaphragm;

an extension or grip similar to a spoon handle furnished on the diaphragm.

18. The liquid dispenser as claimed in claim 16 further comprising a tubular connection extending from a container rim projecting radially beyond the diaphragm as far as an interior of the storage container is provided in a container wall, wherein the outlet tube points towards the diaphragm, and wherein the outlet tube is inserted into this tubular connection;

wherein a radial hole is opening directly into the interior of the storage container through an internal bottom and is provided in the container wall and wherein this hole meets a second, vertical or almost vertical, hole in the container wall, which second, vertical or almost vertical, hole starts from the container rim projecting radially beyond the diaphragm, wherein the outlet tube is pushed or pressed into this second hole, wherein an end (13) of said outlet tube is bent towards the diaphragm, and wherein the radial hole is sealed off from the outside by a plug or peg;

wherein the tubular connection is formed on a side of the container wall;

wherein the tubular connection or second hole is divided by a step into a narrower section and a wider section and wherein the outlet tube is pushed into the wider section and rests on the step.

19. The liquid dispenser as claimed in claim 16, wherein the diaphragm and/or the outlet tube and/or the storage container is colored in accordance with a color code denoting the contents of the storage container;

wherein the storage container and the outlet tube are composed of a noncorroding material;

wherein the diaphragm is composed of silicone rubber.

20. The liquid dispenser as claimed in claim 16, wherein the diaphragm (3) is composed of polystyrene and wherein a sealing ring is arranged between the diaphragm (3) and a step (4) on an inner edge of the storage container;

wherein the diaphragm is a disposable part for a single use.

* * * * *